United States Patent [19]

Zago

[11] Patent Number: 4,532,658

[45] Date of Patent: Aug. 6, 1985

[54] PROTECTIVE HELMET FOR THE HEAD WITH LOCKING MEANS

[75] Inventor: Gianni Zago, Pordenone, Italy

[73] Assignee: Patents Engineering S.r.l., Pordenone, Italy

[21] Appl. No.: 320,575

[22] Filed: Nov. 12, 1981

[30] Foreign Application Priority Data

Nov. 19, 1980 [IT] Italy ..... 60475/80[U]

[51] Int. Cl.[3] ..... A42B 3/02

[52] U.S. Cl. ..... 2/421; 2/424

[58] Field of Search ..... 2/421, 424, 410, 6, 2/5, 423, 205, 185 R, 9, 10

[56] References Cited

U.S. PATENT DOCUMENTS 2,892,195 6/1959 Monetta ..... 2/9

3,418,657 12/1968 Lastnik et al. ..... 2/6

4,290,150 9/1981 Berthelot ..... 2/424 X 4,291,418 9/1981 Zeisler ..... 2/424 X 4,307,885 12/1981 Pidcock ..... 2/185 R

FOREIGN PATENT DOCUMENTS 2462880 2/1981 France ..... 2/424

*Primary Examiner*—Peter Nerbun

*Attorney, Agent, or Firm*—Stevens, Davis, Miller & Mosher

[57] ABSTRACT

Helmet 1 (FIG. 4) is provided on its bottom part with one, preferably two, jaw elements 7 secured to the base of the helmet by hinges 6 and 8. The adjacent ends of jaw elements 5,7 are provided with locking devices consisting of permanent magnets 10 or other types of means.

5 Claims, 8 Drawing Figures

PROTECTIVE HELMET FOR THE HEAD WITH LOCKING MEANS

DESCRIPTION

The present invention relates to a protective helmet for the head, provided with locking means, consisting of one or more rigid-movable elements fitted at the base of the helmet itself, with adaptation and positioning means to the wearer's jaw, said means being hinged on one side and securable on the other side. It is evident that the preferred application of the invention is to protective helmets for motorcyclists and automobile drivers.

At the present state of the art, many types of helmets are known, but these consist of a large opening for the introduction on the wearer's head and are held tightly to the cranium, or are provided with means for securing at the throat with belts or elastic collar stockings.

These helmets have overall drawbacks among which a poor holding capacity and risk of breakage of the belt. In the case of the elastic collar stocking on the other hand, unwanted pressure on the wearer's neck may occur, causing possible perspiration or interference with blood circulation in the compressed zone.

An ideal solution is a helmet in which the head can be easily inserted without obstruction and which may be easily closed and held tightly in place without affecting blood circulation and with a greater protection for the wearer's head and jaws.

This invention differs from the above mentioned helmets, since the base of the helmet is provided with one or two movable elements, hinged on one side and securable on the other, for the purpose of inserting and protecting the head.

The scope of the present invention is to correct the drawbacks of the known types of helmet; specifically, the present invention consists of a rigid helmet manufactured in the conventional manner, in which, in view of the adherence by same to the skull, is allowed the complete and gentle securing of said cranium by means of closure under the chin through one or two rigid elements at the base, which elements - hinged on one side in the first case and on the two opposite sides in the second—open to permit the insertion of the head and close perfectly under it by magnetic means or press studs, so as to create an "egg shell" assembly to enclose the wearer's head, with improved anatomic adaptation and protecting it all from the consequences of falls and traumas deriving therefrom.

The first embodiment of the present invention consists of a helmet in which the action of introducing and enclosing the head is consented by a rigid element, hinged on one side to the base of the helmet and engageable on the other side, as described above, by magnetic means for press studs.

The second emobdiment of the present invention consists of a helmet in which the action of introducing and enclosing the head is made possible by two opposing movable elements fitted at the front of the base of the helmet, hinged to the sides thereof and engageable with each other centrally by magnetic means or press studs.

The invention will now be explained in the following description, to be taken in conjunction with the annexed drawings which illustrate, by way of example some preferred forms of embodiment of the helmet according to the invention.

Figure 1:
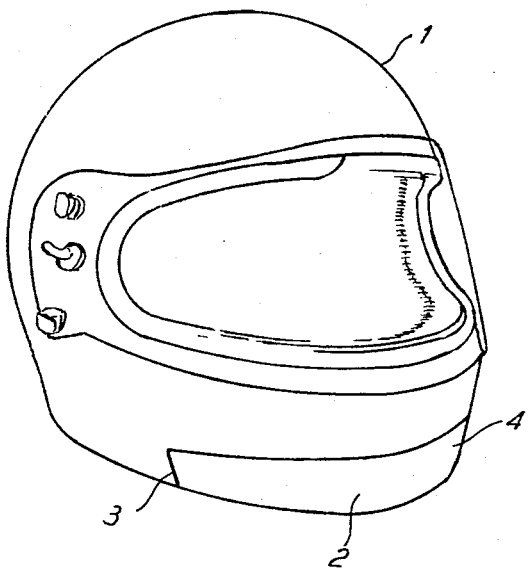
FIGS. 1 and 2 are perspective views of the helmet provided with a rigid closing and securing means to the jaw, shown in the closed and open position, respectively.
Figure 2:
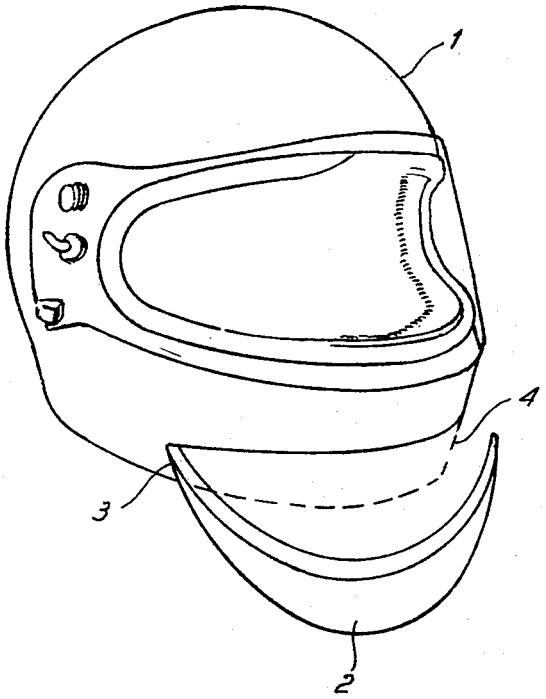

According to the invention, and with specific reference to the first embodiment shown in FIGS. 1 and 2, it can be seen that the helmet according to the invention consists of a part (shell) with vizor 1 and of the rigid closing jaw piece 2 on the base thereof, hinged at point 3 and apt to be closed by magnetic means or press studs at point 4.

Figure 3:
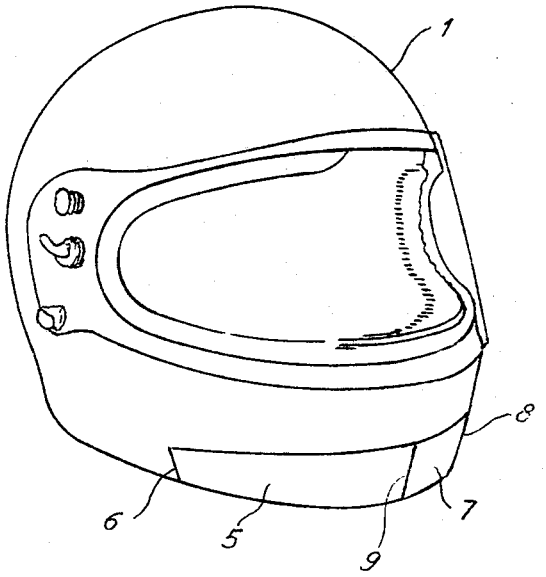
FIGS. 3 and 4 are other perspective views of a first variant in the embodiment of the helmet provided with two jaw elements shown respectively in the closed and open position.
Figure 4:
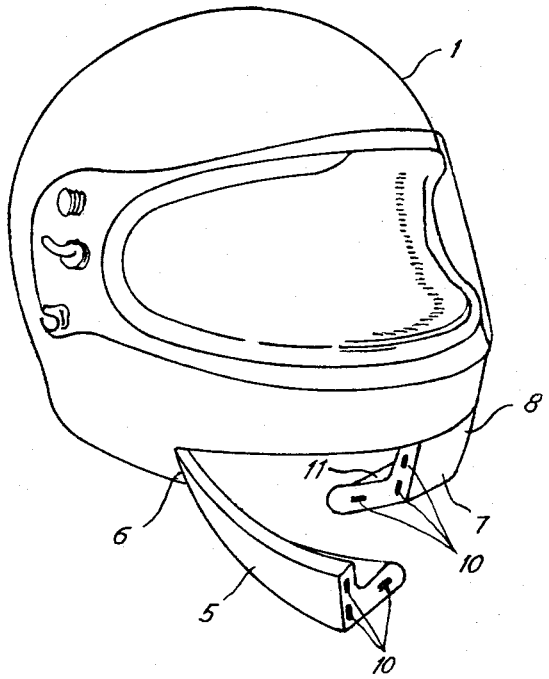

According to the present invention, and with reference in particular to the second embodiment shown in FIGS. 3 and 4, it can be seen that the helmet consists of a part (shell) with vizor 1 and closing jaw pieces 5 and 7, respectively, hinged at positions 6 and 8 and provided with magnetic automatic securing means at position 9.

In the case of magnetic locking as shown in FIG. 4, magnetic plates 10 are used. The same figure also shows the particular L-shaped structure 11 for securing the device automatically under the wearer's chin.

Figure 5:
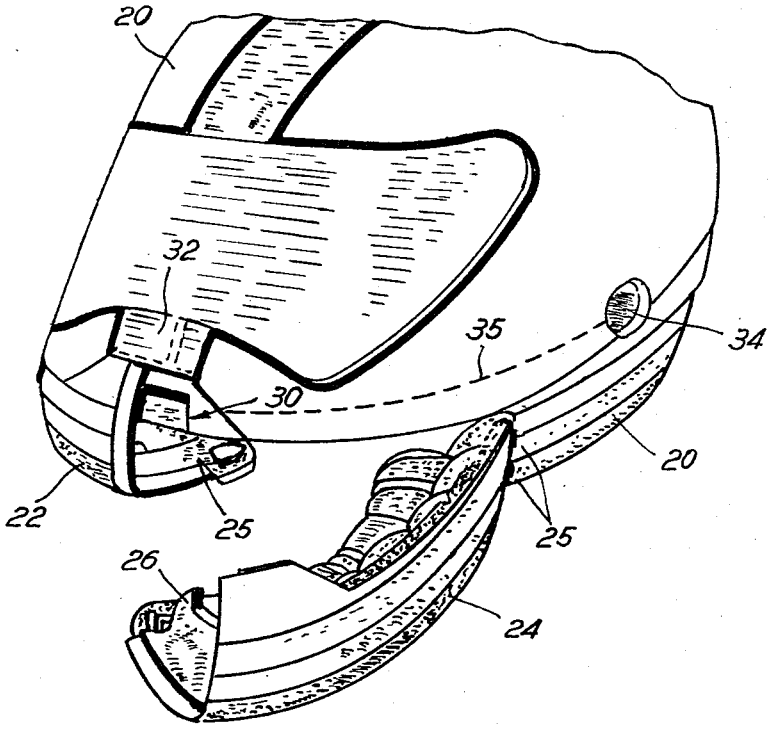
FIG. 5 is similar to FIG. 3 and shows a further variant of the helmet.
Figure 6:
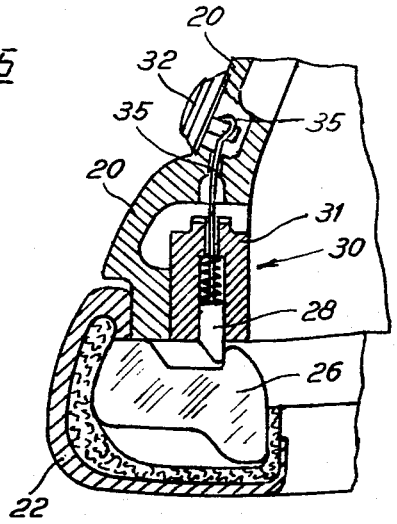
FIG. 6 is a detail in vertical cross section of the helmet shown in FIG. 5.

Considering FIGS. 5 and 6, helmet 20 is provided in its lower part with two jaw locking elements 22 and 24 held on the lower base of the helmet by hinges 25. Said locking elements terminate at their free adjacent ends with hooks 26 which are adjacent and aligned to each other with their teeth to engage the counter-tooth 28 of a lock 30 urged by springs 31 to maintain said elements in the closed position.

The spring locking device 30 is secured on the front wall of helmet 20 which holds, in its middle part, an actuating slider 32 apt to move vertically to shift counter tooth 28 in opposition to the action of springing means 31.

As shown in FIG. 6, the sprung counter tooth 28 can be actuated in parallel with slider 32 also by means of a sprung buttom 34 (FIG. 5) fitted on the side of helmet 20 and operatably connected to counter tooth 28 by an actuating flexible means 35. Thus, the operation of locking device 30 frees the closing elements 22 and 24 of the helmet so that the user may easily lift (remove) the helmet from his head.

Figure 7:
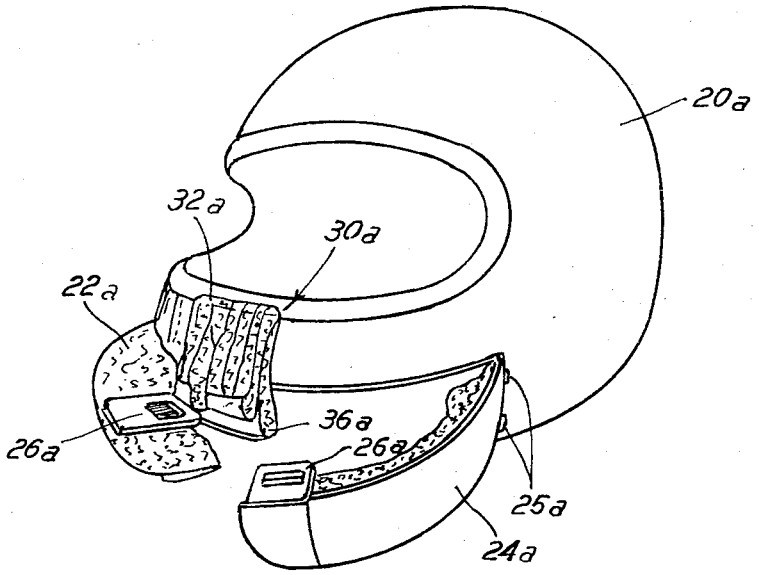
FIG. 7 is a perspective view of a further variant of the helmet.

The variant shown in FIG. 7 is similar to that of FIGS. 5 and 6; in said figures equal or equivalent parts are identified by the same reference numbers with letter index "a".

In this variant, helmet 20 has on its lower part a bracket 36, the bottom of which is aligned with slider **32*a* to house and guide the two hooks 26*a*** which, in the case illustrated, consist of apertures that can be overlapped and in which a sprung counter tooth engages.

Figure 8:
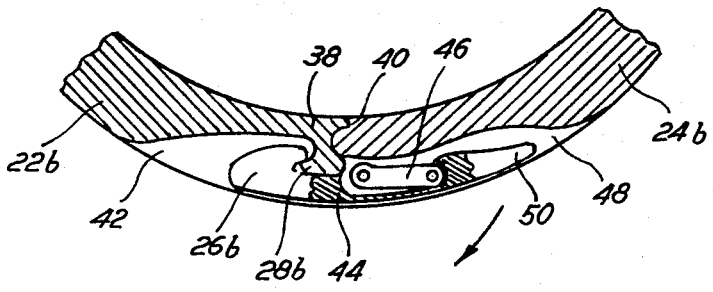
FIG. 8 is a detail in horizontal cross section of a helmet with the locking means for the jaw elements.

In the helmet shown in FIG. 8, the two jaw elements **22*b* and 24*b* are provided, at their contiguous ends with lock-in coupling means 38–40 apt to ensure alignment of said elements in their closed position, provided by locking element 30***a*. The locking element in this variant is of the knuckle joint type to ensure the maximul solidity and resistance when elements 22*a* and 24*a* are in their closed position.

Jaw element 22*b* is provided at its engagement end with a suitably shaped groove 42 housing a tooth 26*b* fitted on one of the ends of lever 44. Said tooth 26*b* engages forcibly a shaped bit 28*b* fitted in a suitable position on the end of jaw element 22*b*.

Lever 44 is pivoted by bush 47 to the end of the other jaw element 24*b* which, in alignment with shaped groove 42, is provided with a corresponding groove 46 to house the other shaped end 50 of lever 44 when the latter is closed.

The jaw elements of the helmet are conveniently shaped to hold the necessary filling material, which is thus interposed between the elements and the user's chin. The filling material may consist of pneumatic pillows inflatable to a suitable pressure so as to achieve a controlled deformation and be easily adaptable to the surface of the chin or other surfaces.

It is understood that the described forms of embodiment may be varied but without altering or departing from the scope of the invention.

I claim:

1. Integral helmet having a cap and a front bottom opening which is provided with two arched complementary segments engagable with the neck of the wearer and which are pivotable so that the helmet is free to pass over the head of the wearer when the segments are not engaged, said two arched segments which complete the bottom opening of the helmet being connected to the cap of the helmet only at ends hinged to the cap of the helmet by vertical axes hinges while the other ends of said arched segments are provided with joining detachable members for the opening of said segments during the removal and/or the putting on of the helmet, said members holding said segments engagable when the helmet is on.

2. The protective helmet according to claim 1, wherein said segments are constituted by magnetic elements fixed at the contiguous ends of the complementary segments.

3. The protective helmet according to claim 1, including a spring-loaded latch fixed to the front of said enclosure and wherein said segments are provided with teeth fixed at the contiguous ends of the complementary segments to engage said spring-loaded latch to maintain said complementary segments in their closed position.

4. The protective helmet according to claim 3 including operation knobs and flexible controls positioned on said enclosure to actuate a slider of the spring-loaded latch.

5. Integral helmet having a cap and a front bottom opening which is provided with two arched complementary segments engagable with the chin of the wearer and which are pivotable so that the helmet is free to pass over the head of the wearer when the segments are not engaged, said two arched segments which complete the bottom opening of the helmet being connected to the cap of the helmet only at ends hinged to the cap of the helmet by vertical axes hinges while the other ends of said arched segments overlap and are provided with complementary locking configurations to ensure alignment with each other during the putting on of the helmet, one said other end defining a groove therein and a bit, the other said other end defining a groove in which is mounted a pivotal lever having a hook which engages forcibly said bit to lock said segments together.

* * * * *